US011213706B2

(12) United States Patent
Hollander, Jr.

(10) Patent No.: US 11,213,706 B2
(45) Date of Patent: Jan. 4, 2022

(54) FIRE EXTINGUISHING DEVICE AND METHOD

(71) Applicant: Lewis E Hollander, Jr., Terrebonne, OR (US)

(72) Inventor: Lewis E Hollander, Jr., Terrebonne, OR (US)

(73) Assignee: Lewis E Hollander, Terrebonne, OR (US)

( * ) Notice: Subject to any disclaimer, the term of this patent is extended or adjusted under 35 U.S.C. 154(b) by 62 days.

(21) Appl. No.: 16/377,296

(22) Filed: Apr. 8, 2019

(65) Prior Publication Data

US 2020/0188713 A1 Jun. 18, 2020

Related U.S. Application Data

(60) Provisional application No. 62/780,212, filed on Dec. 15, 2018.

(51) Int. Cl.
*A62C 19/00* (2006.01)

(52) U.S. Cl.
CPC ..... *A62C 19/00* (2013.01)

(58) Field of Classification Search
CPC ..... A62C 19/00; A62C 37/21; A62C 35/08; A62C 3/025
USPC ..... 169/30
See application file for complete search history.

(56) References Cited

U.S. PATENT DOCUMENTS 5,590,717 A * 1/1997 McBay ..... A62C 35/10 169/26
2005/0139363 A1* 6/2005 Thomas ..... A62C 3/025 169/30

FOREIGN PATENT DOCUMENTS

EP 0390384 A1 * 10/1990 ..... A62C 35/08

* cited by examiner

*Primary Examiner* — Steven M Cernoch
(74) *Attorney, Agent, or Firm* — Dragon Sun Law Firm, PC; Jinggao Li, Esq.

(57) ABSTRACT

A fire extinguishing device comprising liquid nitrogen filled canister-tank attached to a device to release the LN contents; wherein, the release mechanism comprises a small explosive to tear open the canister and rapidly disperse the LN. The bombs are opened at desired locations and are delivered by any means comprising the aerial, vehicle, drone, robotic systems and hand operated by firemen. The device is used for the purpose of extinguishing forest fires or structure fires.

11 Claims, 8 Drawing Sheets

FIRE EXTINGUISHING DEVICE AND METHOD

CROSS-REFERENCE TO RELATED APPLICATION

This non-provisional application claims priority from the provisional application 62/780,212, filed Dec. 15, 2018, the content of which is incorporated herein in the entirety by reference.

Some references, which may include patents, patent applications, and various publications, are cited and discussed in the description of the present disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE INVENTION

The present invention relates to the field of extinguishing fires. Particularly, the present invention relates to extinguishing fires using Liquid Nitrogen (LN). More particularly, the present invention relates to unique systems to deliver LN in the form of bombs to extinguish fire and other methods thereof; wherein the LN is directly in contact with the burning material to extinguish the flame.

BACKGROUND OF THE INVENTION

The rapid increase of global warming has resulted in rising temperatures over the entire world and an emergence of increased uncontrolled fires. Fires and combustion occur not only in buildings and residences but also in the wild. Forest fires occur at a large rate in the United States.

A fire needs three elements to ignite: heat, fuel and Oxygen. Combustion is the chemical reaction that feeds a fire more heat and allows it to continue. Hence, in order to stop a fire, at least one of the elements must be eliminated. Several methods of extinguishing fires have been developed using various fire extinguishing agents such as sprinkler fire extinguishing using water, gaseous CO2 fire extinguishing agents, etc. Another traditional method is to use aerial retardants such as Phos-Chek (ammonium phosphate) which are costly and less effective in cooling or removing oxygen so as to slow the fire. These traditional fire extinguishers are incapable and hence a new and effective method is required.

Nitrogen was first liquefied by two Polish physicists in 1883 and has been used for a plethora of applications including medical, cooling concrete, branding, cooling nuclear reactor storage. The present invention solves the problems of using LN for fire suppression.

The use of liquid nitrogen is very effective and costs around 20 times lower as compared to the available retardants. Additionally, the fire extinguisher of the present invention is available in the form of a liquid nitrogen bomb which is a unique concept and puts out fires with a significant saving in cost. Also, the use of LN is environment friendly.

The use of liquid nitrogen reduces the temperature of out of control fire (such as forest fires) and more importantly it lowers the ratio of Oxygen to Nitrogen to well below the required threshold of combustion i.e. 16% oxygen and combustion of fuel cannot be maintained at levels below 16%, thus extinguishes the fire.

The fire extinguishing method uses only nitrogen which will not cause any harm to the environment. The LN bomb is ideal for a first strike to totally extinguish a fire before it gets started. It is vastly superior to water and other retardants. By using the bomb, a fireman will be able to propel a bomb into the fire cooling the premises and making entrance possible to a burning area quickly to save victims and other firemen. This rapid cooling and fire suppression cannot be achieved by any other means. However, the only precautions that need to be taken in the use of LN are for hypoxia and frostbite. Also, a vent is provided in all containers of LN to prevent pressure build up from the evaporating LN.

SUMMARY OF THE INVENTION

The object of the present invention is to provide a fire extinguishing agent that has sufficient fire suppression capabilities, has minimal adverse effects on the environment and has no hazardous decomposition products.

The invention provides a novel method for using Liquid nitrogen (LN) in insulated bombs wherein the canisters and tanks are filled with LN. The LN is delivered either by a self-detonating bomb or by an insulated tube, hose or piping conveying the liquid directly onto the area of combustion.

In one aspect, the LN bomb is dropped by air, carried by hand or vehicle.

In another aspect, a large tank filled with LN is delivered by a vehicle equipped with an insulated hose to pour the liquid onto the fire.

In a further aspect, a hand carried LN back pack or hand cart where a person or robot can pour the liquid on the combustion area.

In a still further aspect, the bomb is in a dumbbell shape which has the advantage to break in the center to release contents.

BRIEF DESCRIPTION OF THE DRAWINGS

The accompanying drawings illustrate one or more embodiments of the present invention and, together with the written description, serve to explain the principles of the invention. Wherever possible, the same reference numbers are used throughout the drawings to refer to the same or like elements of an embodiment.

The detailed description makes reference to the accompanying figures in which.

DETAILED DESCRIPTION

Figure 1:
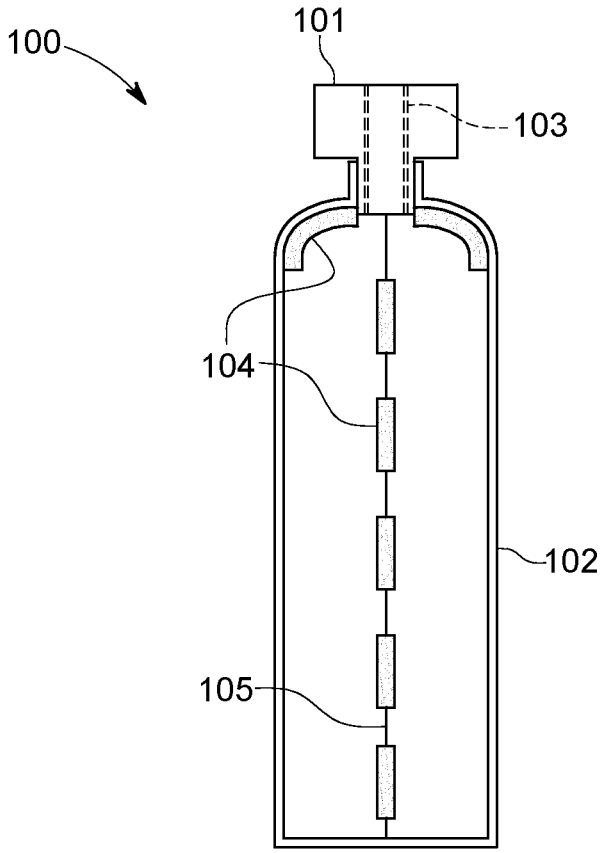
FIG. 1 is an illustration of a Liquid Nitrogen Bomb.

In the following description, for purposes of explanation, numerous specific details are set forth in order to provide a thorough understanding of the present disclosure. It will be apparent, however, to one skilled in the art that the present disclosure can be practiced without these specific details.

Reference in this specification to "one embodiment" or "an embodiment" means that a particular feature, structure, or characteristic described in connection with the embodiment is included in at least one embodiment of the present disclosure. The appearance of the phrase "in one embodiment" in various places in the specification are not necessarily all referring to the same embodiment, nor are separate or alternative embodiments mutually exclusive of other embodiments. Further, the terms "a" and "an" herein do not denote a limitation of quantity, but rather denote the presence of at least one of the referenced items. Moreover, various features are described which may be exhibited by some embodiments and not by others.

The embodiments are described herein for illustrative purposes and are subject to many variations. It is understood that various omissions and substitutions of equivalents are contemplated as circumstances may suggest or render expedient but are intended to cover the application or implementation without departing from the spirit or the scope of the present disclosure.

The present disclosure, in general, describes a fire extinguishing bomb comprising a canister or a tank filled with Liquid nitrogen (LN) which is attached to a device for releasing the LN contents quickly. The LN tank is attached to a release mechanism which comprises a zipper of small explosives, sized sufficient, to tear open the canister and rapidly disperse the liquid nitrogen (LN). The bomb uses small explosive charge attached to the LN canister to open the canister on command. The explosive element used herein is a conventional shot gun shell or bullet with a means to fire said shell or bullet and consequently releasing the LN. The explosive shot gun or bullet is detonated by a firecracker size explosive ignited by the fire which releases a spring-loaded firing pin device to fire the bullet into the canister. The bomb can also be detonated by a spring-loaded device triggered by a conventional fire sprinkler glass bulb filled with glycerin base liquid.

In an embodiment, the explosive can be a fire cracker size and the wick can be ignited by remote control. The bomb is released by ignition of the wick of the explosive or by thermal heat from combustion or by melting the orifice material at the filling plug. The delivery of Nitrogen is the heart of this invention and the extinguishing liquid must come in contact to the burning material. Liquid Nitrogen is very cold and must be kept at −196 degree Celsius which can be achieved by using double walled insulated liquid nitrogen (LN) storage tank. The only hazards associated with using LN for fire extinguishing are hypoxia and freeze burns. All containers of LN are vented to avoid pressure buildup. In other words, a semi porous fill port plug is attached with small holes to the container to avoid building up of very high pressures (e.g. 80,000 psi). There are semi-permeable polyurethane materials to make the fill port tube that solves the venting.

The LN is delivered by an insulated tube, hose or piping conveying the liquid directly on and to the area of combustion. The insulated tank can be mounted on a dolly or cart with an insulated pipe. A heated nozzle is also attached at the end of the pipe to prevent water vapor freezing and causing ice to build up at the discharge.

Further, the invention disclosure provides novel methods of using LN in insulated bombs which are opened at the desired location and delivered by aerial, vehicle, drone, robotic systems and hand operated by firemen.

The bomb is used as a rocket or mortar to propel the bomb to long or short distances, preferably for forest fires or large buildings. The bomb, having a timed release can be thrown, dropped or placed into the fire before personnel entering or approaching a structure. The bomb can also be dropped aerially directly on the burning area of a forest fire where personnel can quickly enter to save lives or secure the area. The dropping of LN bombs targeted at forests or structures at fire can be exploded remotely.

In an embodiment, the tank or containers for LN is prepared from materials selected from glass and metal. Both of the materials are double walled vacuum Dewar, like a thermos (glass) or a coffee cup (metal). The containers can be as large as a 1000 liter or more and as small as a one-liter hand grenade. Glass is easy to explode with a simple fire cracker and a small metal (like coffee cup) can be exploded with a fire cracker on the underside of the plug to blow the plug out. A wide mouth plug flies out releasing contents. Further, for large metal containers the zipper or string of explosives will work at a weakened line.

In a preferred embodiment, the LN bomb is constructed in a dumbbell shape which would break in the center to release contents. Hence, the dropping of the LN bomb so constructed will break apart on impact releasing the LN. This configuration breaks at the neck and pours contents on the fire. Also, the shape of the LN bomb container in a dumbbell shape is used for aerial drop or carried by personnel to shatter on impact. The dumbbell design also works for large bombs breaking on impact.

The dumbbell bomb can be small enough for a person to handle, break in half and throw into combustion area similar to a hand grenade.

In another embodiment, a bomb may comprise 5, 50, 500, 5000 liter or larger amount of LN suited as per the objective. It can be dropped from a plane, helicopter or drone or another airborne device. The bomb then hits the ground, explodes or shatters on impact or a fuse can be ignited to detonate a small charge similar to a firecracker. Approximately, five hundred liters (130 gallons) of liquid nitrogen will extinguish an area of about 100 meters or more in diameter depending on wind conditions. In addition, there will be a reduction in the ambient temperature from the heat of vaporization and the cooling from over 200 deg. C. difference from the LN at −197 degree C. to room temperature depending on local wind conditions. This cooling and removal of the oxygen cannot be achieved by any other current fire suppression methods.

Though the LN bomb is environment-safe, still two hazards are associated with it; one is hypoxia and the other is frost bite. Hence, addition of a breathing apparatus for fireman, consisting of an oxygen enriched air tank in addition to the LN tank can be used to prevent hypoxia. Either or both tanks could be placed on a hand cart, dolly or backpack.

The bomb can be delivered to the combustion area by using various ways. In one embodiment, the bomb is delivered by aerial means for forest fire suppression by plane, drone, helicopter, or other aerial means. The bombs would drop to the forest floor and then be detonated to release the LN giving maximum effect. In another embodiment, the bomb can be delivered as a projectile fired towards the burn area, forest or structure to release LN on impact or other means as described above.

The LN bomb can be delivered by motorized vehicle such as a fire truck, or other type of trucks or quad or robotic machine using an insulated piping to pour the liquid on the desired area. The LN bomb-canister is delivered by rocket or artillery shell to remote locations and can then be detonated by the fire itself, or by impact or thermally or controlled remotely.

In a further embodiment, the LN canister-bomb can be delivered by robotic vehicle to areas that are too hot or inaccessible. The LN can also be delivered by robotic vehicles comprising a tank and piping capability to cover inaccessible and hostile areas.

In an example, if a 5 liter (1.32 gallons) canister is released in a 10 cubic meter room, it would lower the oxygen to nitrogen ratio to 13.8% well below the 16% required to extinguish the fire and it would cool the room by as much as 50 degree C. [Code of Practice "Safe Use of Liquid Nitrogen" August 2004. Royal Free Hampstead NHS Trust and Royal Free & University College Medical School; pg. 9]. This can be expanded to a forest fire where bombs can be dropped directly on burning targets and then opened by a number of mechanisms described herein. Further, the explosive needed for smaller units can be a conventional firecracker with wick and could be ignited by the fire. The bomb is used by firemen who have urgent need to enter an area where victims or other firemen are trapped and the area needs to be cooled immediately, LN will cool the area and put the fire out; hence many lives maybe saved.

The principles and operations of the various configurations according to the present invention can best be understood with reference to the drawings and accompanying discussion.

Referring now to the drawings wherein like numerals designate like and corresponding parts throughout the several views, FIG. 1 illustrates a basic embodiment of a Liquid nitrogen bomb for extinguishing fire according to the present invention. Here, the LN bomb (100) comprises a LN tank (102) attached to a release mechanism to open the canister and small explosives (104) sized sufficient to tear open the canister to finally disperse the LN. Further, the explosives are detonated by a wick (105) which is ignited by fire similar to a common firecracker. The bomb also comprises a filling port (101) at the top end for filling up the bomb with liquid nitrogen wherein the lid/port (101) further comprises semi-porous plug or cap i.e. vent holes (103) so that the excess nitrogen can be vented. In one embodiment, the release mechanism can comprise a zipper (not shown in figure).

Figure 2A:
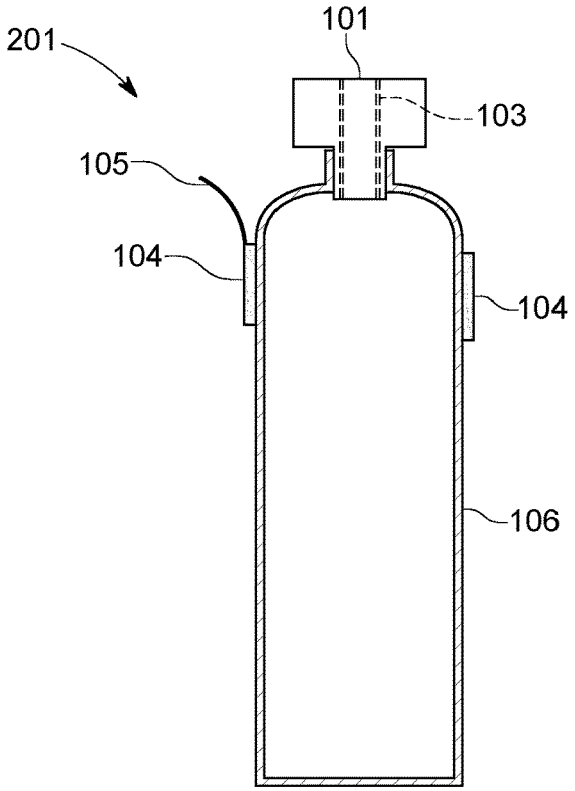
FIG. 2A, FIG. 2B and FIG. 2C are illustrations of types of materials used to make the wall of bomb tank.

FIG. 2A illustrates a glass double walled Dewar. Here, the LN tank of bomb is glass walled (106).

Figure 2B:
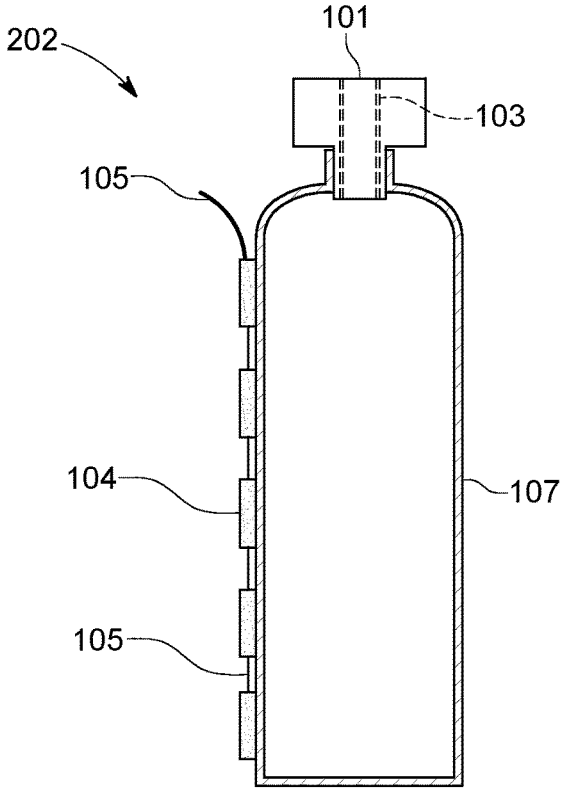

FIG. 2B illustrates a metal double walled Dewar; wherein the LN tank of bomb is metal walled (107).

Figure 2C:
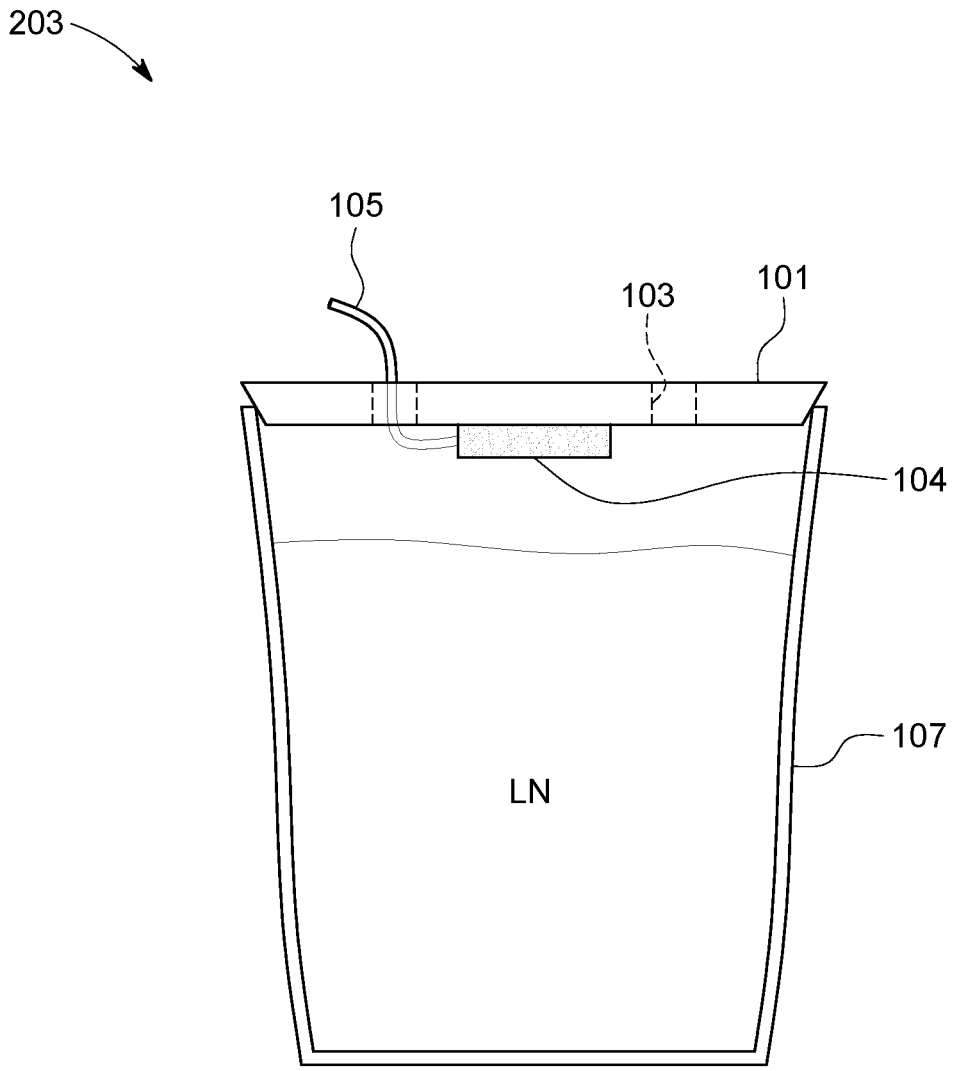

FIG. 2C further illustrates another embodiment of LN bomb comprising a metal Dewar (107) with the explosive (104) on the inside under the lid (101) to plow off the lid; wherein the charge is inside of the lid and explodes the lid off.

The bomb of FIG. 2A, FIG. 2B, FIG. 2C comprises a wick (105) that would ignite the bomb on contact with fire.

Figure 3:
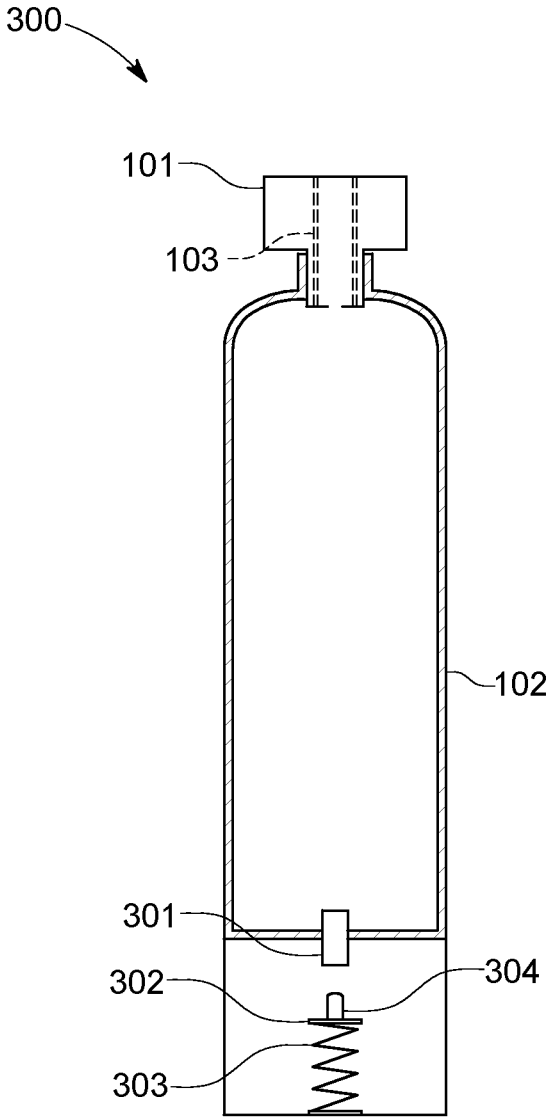
FIG. 3 is an illustration of a conventional shot gun shell or bullet containing bomb.

FIG. 3 illustrates a bomb with conventional shot gun shell or bullet type explosive element. The shot gun shell/bullet bomb comprises a shot gun shell (301), a heat sensitive element (302), a spring-loaded device (303) to release the firing pin (304) triggered either by a fire cracker or a glass bulb similar to a sprinkler head.

Figure 4:
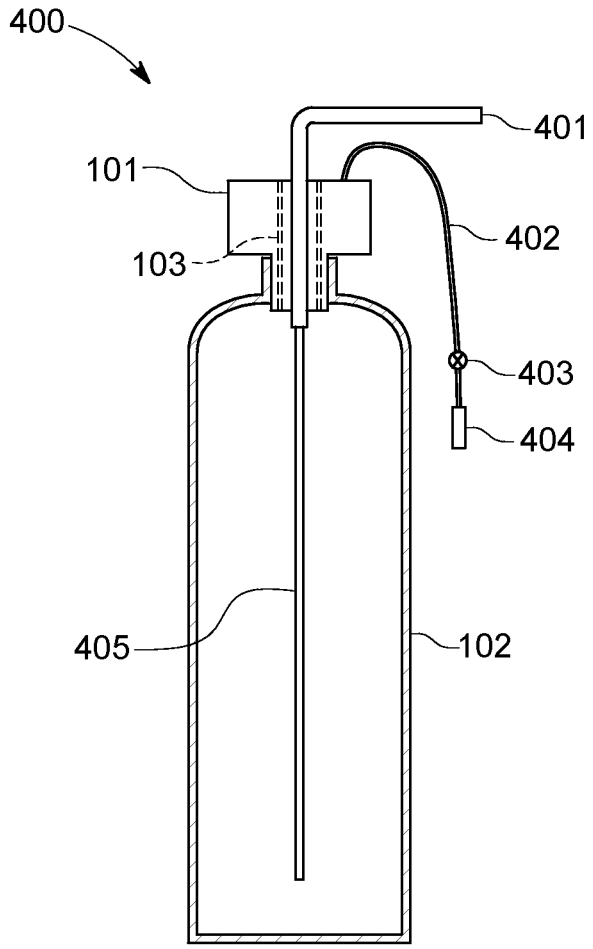
FIG. 4 is an illustration a liquid nitrogen tank with insulated hose.

FIG. 4 illustrates a controlled pressure cylinder of Liquid Nitrogen (400) with an insulated hose (401) to pour the liquid nitrogen. The tank comprises a liquid nitrogen pipe (405), small hose (402) which is attached to a valve (403) and a pressure pump (404).

Figure 5:
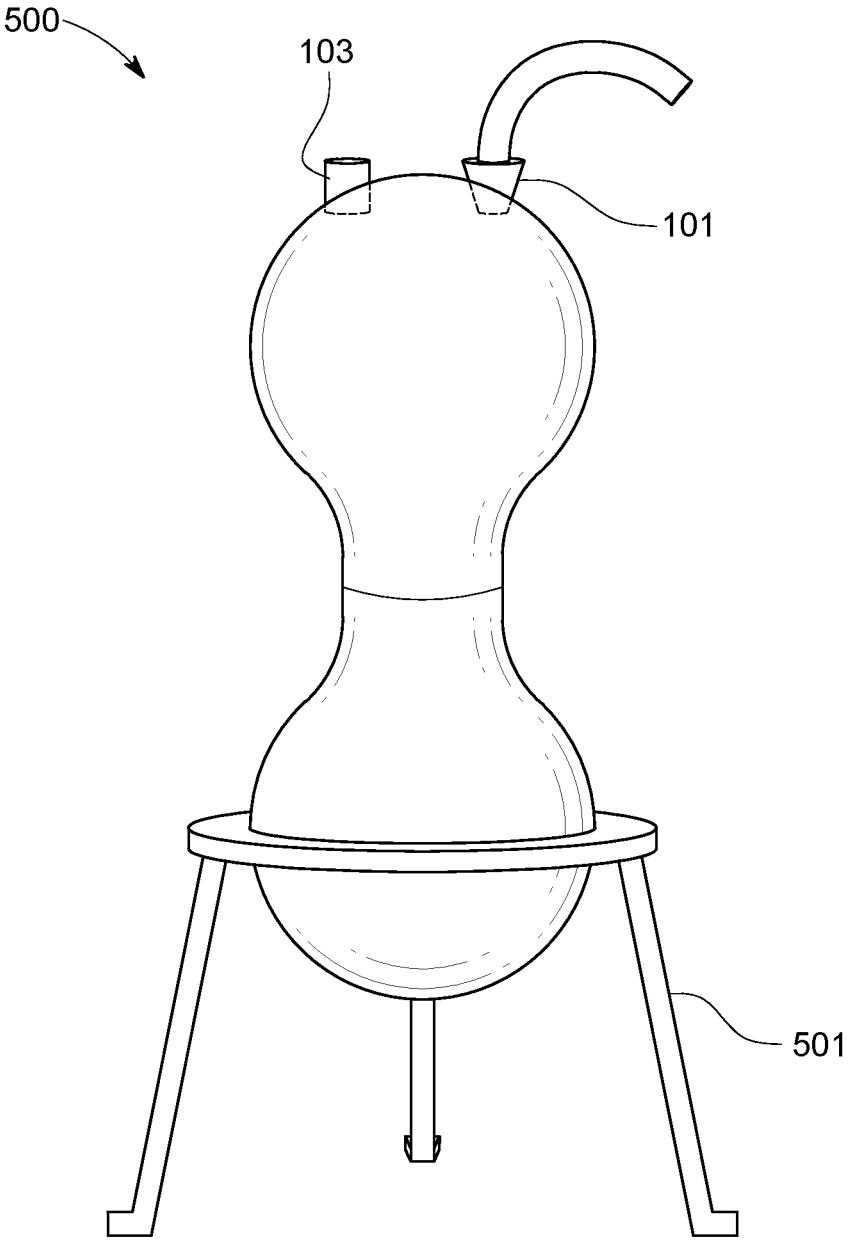
FIG. 5 is an illustration of Dumbbell shape Bomb.

In FIG. 5, a dumbbell shaped bomb (500) is illustrated which is designed to break open in the center on impact to release contents. The bomb also comprises a carrier (501) for transport.

Figure 6:
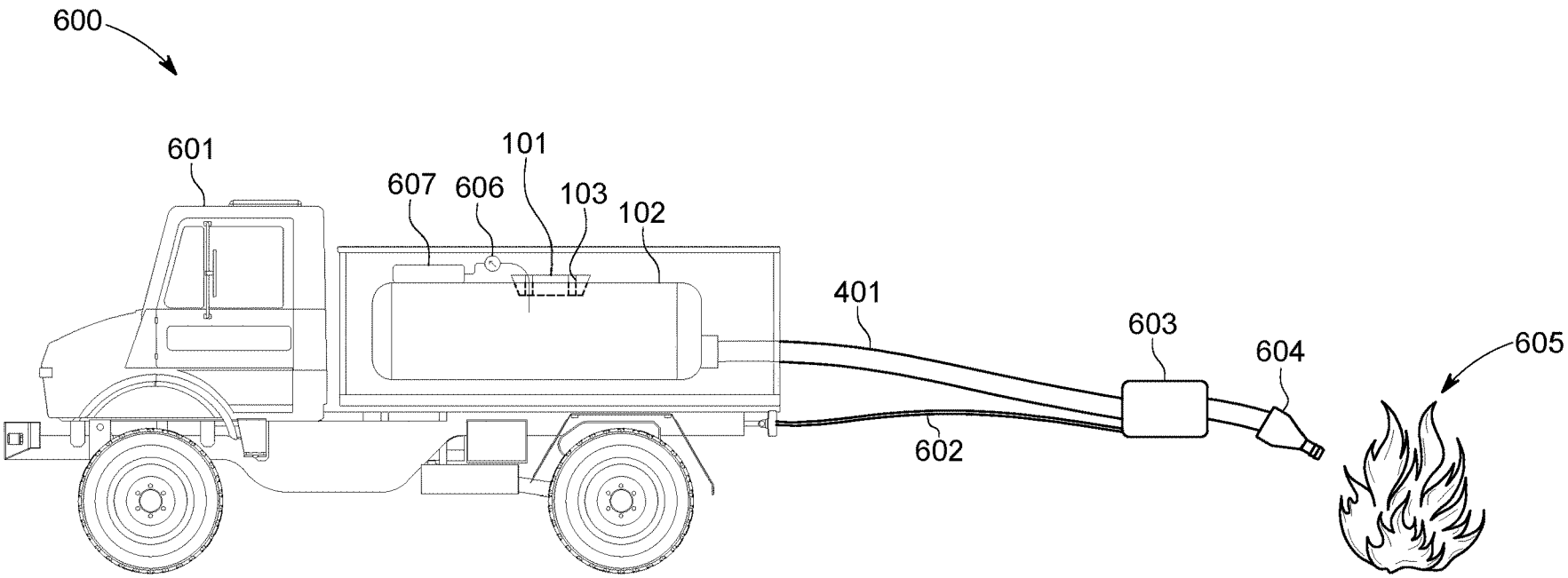
FIG. 6 is an illustration of a fire vehicle or fire truck to deliver the liquid nitrogen tank.

FIG. 6 illustrates a fire vehicle or fire truck (600) comprising a LN tank (102) which is attached to an insulated pipe (401). The insulated pipe (401) further comprises a heater (603) which is used to prevent the buildup of ice. The heater is connected with electric wires (602) to provide electricity connection. Further, a nozzle (604) is present at the end of the insulated pipe (401). The liquid nitrogen passes through the insulated pipe to extinguish fire (605). The LN tank (102) also comprises a fill plug (101) with vent (103) and compressed nitrogen cylinder (607) along with a pressure control tube (606) to act as a pump for the LN on the top middle of the tank. The similar set-up can be used for Robotic machines or quad.

Figure 7:
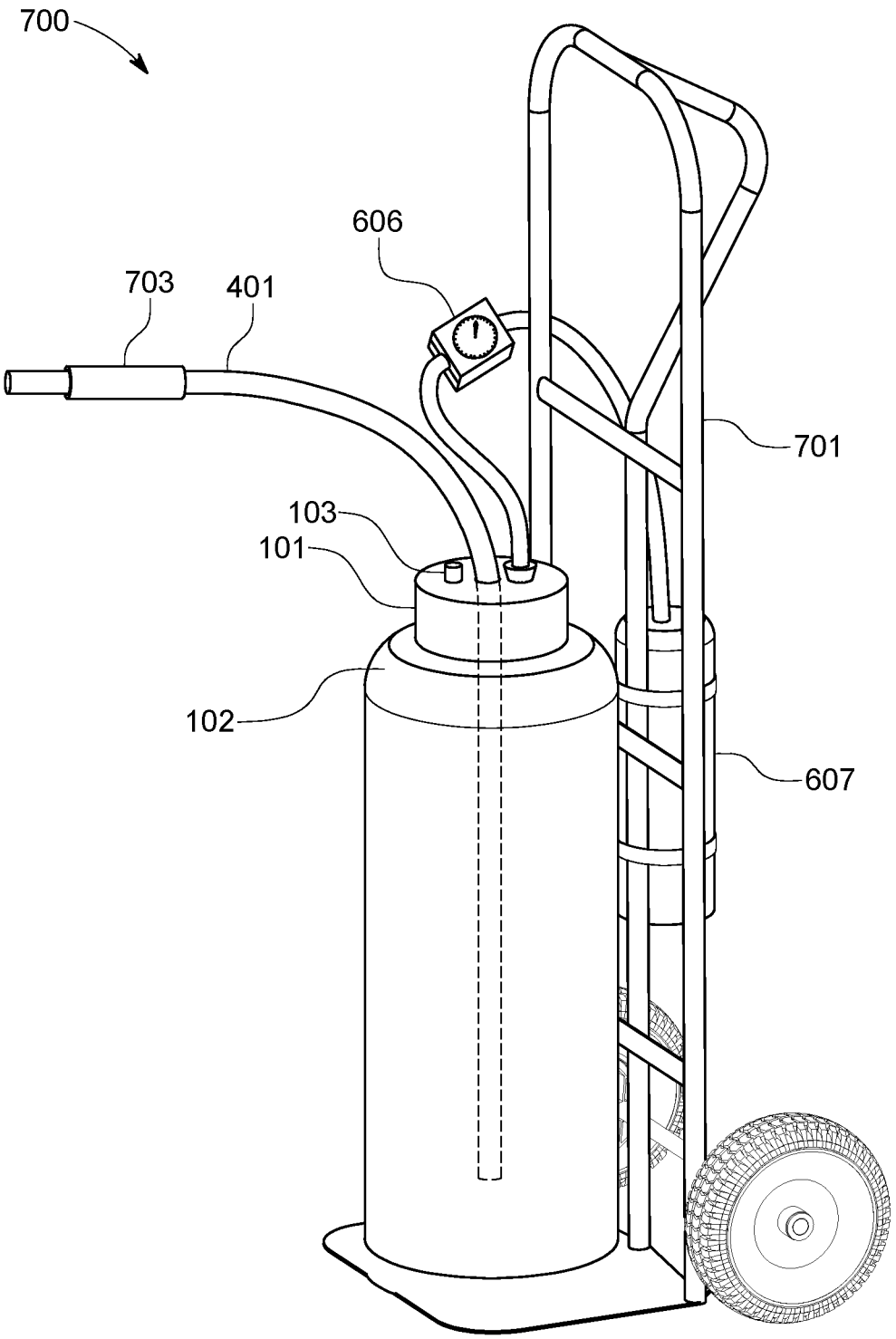
FIG. 7 is an illustration of a fire extinguisher mounted on a dolly or cart.

FIG. 7 illustrates a fire extinguisher mounted on dolly or hand cart (700) that can be handled by any individual. The fire extinguisher comprises a LN tank (102), an insulated pipe (401) along with an extra insulation (703) for hand hold and a filling port (101) which is supported on a dolly (701). In another embodiment, the fire extinguisher can also be utilized as a back pack as the LN being contained in an insulated tank; it can be attached to a back pack type fire extinguisher with an insulated pipe and nozzle to pour the liquid onto the burning area. However, dolly is the most preferred embodiment of LN extinguisher as the tank can be mounted over it. Another reason for preferring dolly is that the pressure cylinder and valve can be strapped to the dolly to control the flow.

A comparison between the properties of conventional extinguishers liquid nitrogen has been provided below.

TABLE I

| | Density | Heat of Vaporization | Boiling Point | Cost |
|---|---|---|---|---|
| Liquid Nitrogen | 1.225 Kg/M$^3$ | 837 cal/gr | −196° C. | $.03/liter |
| Water | 0.997 Kg/M$^3$ | 533 cal/gr | 100° C. | 0 |
| Phos-Chek Slurry | | | | $0.53/liter |

The foregoing description of the exemplary embodiments of the present invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A fire extinguishing bomb comprising:

a cylindrical canister filled with liquid nitrogen (LN);

a filling port at the top of the cylindrical canister and comprising a filling plug with a vent; and a release device attached to the cylindrical canister;

wherein the release device comprises a first explosive and a second explosive to tear open or shatter the canister for rapidly dispersing the LN on the flame;

wherein the first explosive is disposed on a bottom surface of a top wall of the cylindrical canister and the second explosive is a string of explosives connected via a wick;

wherein the wick is configured to be ignited thus detonating the first explosive and the second explosive; one end of the wick is connected to a top surface of a bottom wall of the cylindrical canister; the other end of the wick is connected to the first explosive; and the wick is perpendicular to the top surface of the bottom wall and disposed in the center of the cylindrical canister;

wherein the LN is released by ignition of the first explosive and the second explosive by the wick; and wherein the fire extinguishing bomb extinguishes a fire when LN comes in direct contact with a fire combustion depriving the fire of oxygen.

2. The fire extinguishing bomb as claimed in claim 1, wherein the size of the canister ranges from but not limited to 0.5 to 10,000 liters.

3. The fire extinguishing bomb as claimed in claim 1, wherein the fire extinguishing bomb is dropped through aerial means to extinguish forest fires or structure fires.

4. The fire extinguishing bomb as claimed in claim 3, wherein the aerial means is a plane, a drone, or a helicopter.

5. The fire extinguishing bomb as claimed in claim 3, wherein the LN bomb is dropped at forest or structure fire locations and is exploded remotely.

6. The fire extinguishing bomb as claimed in claim 1, wherein, the LN is released by melting vent material at the fill plug.

7. The fire extinguishing bomb as claimed in claim 1, wherein the bomb is used as a rocket or mortar to propel the bomb to long or short distances, for forest fires or large buildings.

8. The fire extinguisher bomb as claimed in claim 1, wherein the LN canister comprises an opening with the explosive under the lid, one hole for a wick, and a second hole for a vent.

9. The fire extinguisher bomb as claimed in claim 1, wherein bomb canister material is insulated.

10. The fire extinguisher bomb as claimed in claim 1, wherein the wick is ignited by remote control.

11. The fire extinguisher bomb as claimed in claim 1, wherein the fill plug is a semi porous fill port plug with holes.

* * * * *